US006036606A

United States Patent [19]

Dumas

[11] Patent Number: 6,036,606

[45] Date of Patent: Mar. 14, 2000

[54] GOLF COURSE WITH MULTI-SEQUENTIAL ARRANGEMENT OF GOLF LINKS

[76] Inventor: Denis Dumas, 715 rue Dorion, St. Hyacinthe, Quebec, Canada, J2S 8P7

[21] Appl. No.: 08/847,888

[22] Filed: Apr. 28, 1997

[51] Int. Cl.[7] ..... A63B 67/02

[52] U.S. Cl. ..... 473/169

[58] Field of Search ..... 473/150, 167–171, 473/409

[56] References Cited

U.S. PATENT DOCUMENTS

| | | |
|---|---|---|
| 2,455,806 | 12/1948 | Reach . |
| 2,482,210 | 9/1949 | Reach, Sr. et al. . |
| 2,550,480 | 4/1951 | Hubbard . |
| 3,156,470 | 11/1964 | Newkirk . |
| 3,719,360 | 3/1973 | Purdy . |
| 3,904,209 | 9/1975 | Thomas . |
| 4,019,748 | 4/1977 | Healey . |
| 4,129,300 | 12/1978 | Magnuson . |
| 4,157,831 | 6/1979 | Renn . |
| 4,572,512 | 2/1986 | Tegart . |
| 4,872,686 | 10/1989 | Trasko . |
| 4,988,105 | 1/1991 | Perry et al. . |
| 5,076,586 | 12/1991 | Taniguchi et al. . |
| 5,112,054 | 5/1992 | Oswald . |
| 5,213,330 | 5/1993 | Benson . |
| 5,265,875 | 11/1993 | Fitzgerald . |
| 5,419,561 | 5/1995 | Weber . |

*Primary Examiner*—Mark S. Graham
*Attorney, Agent, or Firm*—Carter & Schnedler

[57] ABSTRACT

A golf course and a method of construction is described whereby to permit a plurality of sequential arrangements of golf links within the golf course so that golf players can play the same nine or eighteen golf links of the course but in a plurality of different golf link sequential arrangements. The golf course has a plurality of putting green areas which are spaced apart from one another with each being associated with one or more fairway areas to constitute a plurality of golf links. A tee area is associated with the fairway area of each of the golf links. A designation identifies individual ones of the golf links. The green areas and fairway areas are disposed in a predetermined web pattern to permit a plurality of these sequential arrangements of the links with the putting green areas having a single associated one of the fairway areas in each of the sequential arrangements.

13 Claims, 8 Drawing Sheets

HOLES — LINKS COMBINATIONS "$Y_1$"

| X | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 1 | A | A | A | A | A | A | A | A | A | A | A | A | A | C | C | C | C | E |
| 2 | B | B | B | B | B | B | B | B | B | C | C | C | C | A | A | A | A | C |
| 3 | C | C | C | C | C | D | D | D | D | B | B | B | B | B | B | B | B | A |
| 4 | D | D | D | D | E | C | C | C | F | D | D | D | D | D | D | D | D | B |
| 5 | E | F | F | F | D | E | F | F | C | E | F | F | F | E | F | F | F | D |
| 6 | F | E | H | H | F | F | E | H | E | F | E | H | H | F | E | H | H | F |
| 7 | H | H | E | G | H | H | H | E | H | H | H | E | G | H | H | E | G | H |
| 8 | G | G | G | E | G | G | G | G | G | G | G | G | E | G | G | G | E | G |
| 9 | I | I | I | I | I | I | I | I | I | I | I | I | I | I | I | I | I | I |

Y

FIG. 3A

FRONT 9 — BACK 9

| Z1 | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 1 | ✓ | ✓ | ✓ | ✓ | ✓ | ✓ | ✓ | ✓ | | ✓ | ✓ | ✓ | ✓ | | | | | |
| 2 | ✓ | ✓ | ✓ | ✓ | | ✓ | ✓ | ✓ | ✓ | ✓ | ✓ | ✓ | ✓ | | | | | |
| 3 | | ✓ | ✓ | ✓ | | | ✓ | ✓ | ✓ | | ✓ | ✓ | ✓ | | | | | |
| 4 | | | ✓ | ✓ | | | | ✓ | | | | ✓ | ✓ | | | | | |
| 5 | ✓ | ✓ | ✓ | ✓ | ✓ | | | | | ✓ | ✓ | ✓ | ✓ | | | | | |
| 6 | ✓ | ✓ | ✓ | ✓ | ✓ | ✓ | ✓ | ✓ | | | | | | | | | | |
| 7 | ✓ | ✓ | ✓ | ✓ | | ✓ | ✓ | ✓ | ✓ | | | | | | | | | |
| 8 | | ✓ | ✓ | ✓ | | | ✓ | ✓ | ✓ | | | | | | | | | |
| 9 | | | | | | ✓ | ✓ | ✓ | ✓ | | | | | | | | | |
| 10 | ✓ | ✓ | ✓ | ✓ | ✓ | ✓ | ✓ | ✓ | | ✓ | ✓ | ✓ | ✓ | ✓ | ✓ | ✓ | ✓ | |
| 11 | ✓ | ✓ | ✓ | ✓ | | ✓ | ✓ | ✓ | ✓ | ✓ | ✓ | ✓ | ✓ | ✓ | ✓ | ✓ | ✓ | |
| 12 | | ✓ | ✓ | ✓ | | | ✓ | ✓ | ✓ | | ✓ | ✓ | ✓ | | ✓ | ✓ | ✓ | |
| 13 | | | ✓ | ✓ | | | | ✓ | | | ✓ | ✓ | ✓ | | | ✓ | ✓ | |
| 14 | | | | | | | | | | ✓ | ✓ | ✓ | ✓ | ✓ | ✓ | ✓ | ✓ | |
| 15 | | | | | | | | | | ✓ | ✓ | ✓ | ✓ | ✓ | ✓ | ✓ | ✓ | |
| 16 | | | | | | | | | | | ✓ | ✓ | ✓ | | ✓ | ✓ | ✓ | |
| 17 | | | | | | | | | | | | ✓ | ✓ | | | ✓ | ✓ | |
| 18 | | | | | | | | | | | | | | ✓ | ✓ | ✓ | ✓ | ✓ |

FIG. 3B

9 GREEN COURSE MANAGEMENT

| STARTING TIME | GOLF GROUPS | COURSE | |
|---|---|---|---|
| 07:00 | A | 12 | ACB DFH EGI |
| 07:10 | B | 12 | ACB DFH EGI |
| 07:20 | C | 12 | ACB DFH EGI |
| 07:30 | FREE TIME (L) | 12 | ACB DFH EGI |
| 07:40 | D | 12 | ACB DFH EGI |
| 07:50 | E | 12 | ACB DFH EGI |
| 08:00 | F | 12 | ACB DFH EGI |
| 08:10 | G | 12 | ACB DFH EGI |
| 08:20 | H | 12 | ACB DFH EGI |
| 08:30 | I | 12 | ACB DFH EGI |
| 08:40 | J | 12 | ACB DFH EGI |
| 08:50 | K | 12 | ACB DFH EGI |
| | FREE TIME | | |
| 09:10 | $A^2$ | 15 | CAB DFE HGI |
| 09:20 | $B^2$ | 15 | CAB DFE HGI |
| 09:30 | $C^2$ | 15 | CAB DFE HGI |
| 09:40 | L | 15 | CAB DFE HGI |
| 09:50 | $D^2$ | 15 | CAB DFE HGI |
| 10:00 | $E^2$ | 15 | CAB DFE HGI |
| 10:10 | $F^2$ | 15 | CAB DFE HGI |
| 10:20 | $G^2$ | 15 | CAB DFE HGI |
| 10:30 | $H^2$ | 15 | CAB DFE HGI |
| 10:40 | $I^2$ | 15 | CAB DFE HGI |
| 10:50 | $J^2$ | 15 | CAB DFE HGI |
| 11:00 | $K^2$ | 15 | CAB DFE HGI |
| | FREE TIME | | |
| 11:20 | M | 10 | ABC DEF HGI |
| 11:30 | N | 10 | ABC DEF HGI |
| 11:40 | O | 10 | ABC DEF HGI |
| 11:50 | $L^2$ | 10 | ABC DEF HGI |
| 12:00 | P | 10 | ABC DEF HGI |
| 12:10 | Q | 10 | ABC DEF HGI |
| 12:20 | R | 10 | ABC DEF HGI |
| 12:30 | S | 10 | ABC DEF HGI |
| 12:40 | T | 10 | ABC DEF HGI |
| 12:50 | U | 10 | ABC DEF HGI |
| 13:00 | V | 10 | ABC DEF HGI |
| 13:10 | W | 10 | ABC DEF HGI |
| | FREE TIME | | |

41 42 40 40 40

FIG. 3C

BASIC DESIGN FOR GREEN D

BASIC DESIGN FOR GREEN C

BASIC DESIGN FOR GREENS A,B,F,G,H,I

BASIC DESIGN FOR GREEN E

GOLF COURSE WITH MULTI-SEQUENTIAL ARRANGEMENT OF GOLF LINKS

TECHNICAL FIELD

The present invention relates to a golf course and its method of construction and wherein the green areas and fairway areas are oriented on a web pattern to provide a plurality of sequential arrangements of the golf links within the golf course.

BACKGROUND ART

It is known in the construction of golf courses to arrange the putting green areas at predetermined locations whereby to minimize the surface area occupied by the golf course. For example, reference is made to U.S. Pat. No. 3,156,470 which shows a golf course layout wherein there is provided nine green areas with each of the green areas being associated with two permanent distinct fairways. A first of the fairways forms part of the first 9 holes of golf and wherein the second of the fairways forms part of the second 9 holes of golf. Accordingly, each green is played twice but from a different approach such that there is provided eighteen golf holes which are different, but the same eighteen fairways and nine greens are played over and over again. A major disadvantage of such a golf course is that only 9 holes of golf can be occupied by players at one time so that two groups of golf players do not play on a green at the same time. Otherwise, this would make the game dangerous and very confusing. It is also noted that the same order of golf holes are played over and over again.

In U.S. Pat. No. 4,157,831, there is disclosed a golf course which is designed with a polygonal outside perimeter and wherein groups of greens and tee areas are disposed at the apices of the hexagon. A disadvantage of this golf layout is again that it renders the game dangerous as the green areas and tee areas are grouped together and furthermore the fairway areas cross themselves inbetween the apices making it dangerous for the golf playing person to venture onto such golf course as he may be seriously injured by flying golf balls in the fairway, tee areas and green areas. Again, the main purpose of this golf course arrangement was to minimize on land use.

U.S. Pat. No. 4,872,686 relates to a rectangular golf course design formed by rectangular areas each comprising three closely spaced holes. These rectangular areas can be grouped side-by-side or end-to-end. The purpose of this arrangement is to attempt to minimize the time of play of a typical 18-hole golf course while maintaining the yardage regulation.

Finally, U.S. Pat. No. 5,076,586 teaches another golf course layout wherein 9 holes of play can be achieved by providing three different golf cups on each of three putting green areas. The green areas must therefore be very large. The putting green areas are approached from three different tee off directions. The green areas as well as the fairway areas cannot be shared by three different groups of golfers as this would make the game of golf dangerous for the reasons, as mentioned above, that golfers can be hit by golf balls projected over the fairway areas as well as to the green areas where groups of golfers may be putting. This course is a three hole golf course which can be played successively but from different directions using the same three fairways and three greens.

SUMMARY OF INVENTION

It is a feature of the present invention to provide a golf course which comprises a plurality of golf link sequential arrangements which are obtainable by orienting putting green areas and fairway areas in a predetermined web pattern and wherein there are more fairway areas than putting green areas with the putting green areas having a single associated one of the fairway areas in each of the sequential arrangements.

Another feature of the present invention is to provide a golf course comprising a plurality of putting green areas and a plurality of fairway areas and wherein the green areas and fairway areas are disposed in a predetermined web pattern to permit a plurality of sequential arrangements of golf links with the putting green areas having a single associated one of the fairway areas in each of the sequential arrangements.

Another feature of the present invention is to provide a method of constructing a golf course to permit a plurality of sequential arrangements of golf links within the golf course and wherein the putting green areas have a single associated one of the fairway areas.

With the present invention there is provided a golf course wherein the putting green areas are not shared with other golfers but are associated with a specific fairway area depending on the selected one of a plurality of sequential arrangements of the golf links so that many different orders of golf links may be played on the same course.

With the golf course of the present invention and by using, for example, nine putting green areas oriented in the predetermined web pattern, it is possible to obtain eighteen different golf link arrangements. Another web pattern of nine links may be easily adapted to an existing 9 golf hole web design to permit much greater sequential arrangements of the golf links.

According to a further broad aspect of the present invention, there is provided a golf course which comprises a plurality of putting green areas which are spaced apart from one another and each associated with two or more fairway areas to constitute a plurality of golf links. A tee area is associated with the fairway area of each of the golf links. Designation means is provided to identify individual ones of the golf links. The green areas and fairway areas are disposed in a predetermined web pattern to permit a plurality of sequential arrangements of the golf links with the putting green areas having a single associated one of the fairway areas in each of the sequential arrangements. At least one of the putting green areas is displaced to a different position in the plurality of sequential arrangements.

According to a further broad aspect of the present invention there is provided a method of constructing a golf course to obtain a plurality of sequential arrangements of golf links within the golf course. The method comprises the steps of disposing a plurality of putting green areas, spaced-apart, and oriented with respect to a web pattern having at least two substantially parallel spaced-apart axes and at least three substantially parallel transverse axes. Fairway areas are delineated between the putting green areas along the axes. Diagonal fairway areas are also delineated along diagonal axes between some of the putting green areas. Tee areas are provided for the fairway areas. Designation means are also provided to identify the golf links formed by individual ones of the fairway areas in association with one of the putting green areas. There are more fairway areas than putting green areas to constitute a plurality of sequential arrangements of the golf links. A specific sequential arrangement of the golf link is identified to direct a golf playing person through the golf course.

According to a further broad aspect of the present invention there is provided a Table on which the plurality of sequential arrangements of the golf links are identified whereby to select a specific one of the arrangements to direct a golf playing person along the golf course and wherein this arrangement may be changed from time to time so that the golf links of the golf course may be played several times but in a different arrangements.

BRIEF DESCRIPTION OF DRAWINGS

A preferred embodiment of the present invention will now be described with reference to the accompanying drawings in which:

FIG. 3A is a Table illustrating the various sequential arrangements of a 9-hole golf course constructed in accordance with the present invention;

FIG. 3B is a Table illustrating all combinations that are selectable for a nine link golf course to permit switching to mountable links after a front nine course so that the back nine course does not interfere with play;

FIG. 3C is a further Table showing an example of how a nine link course can be switched at nine hole intervals;

DESCRIPTION OF PREFERRED EMBODIMENTS

Figure 1:
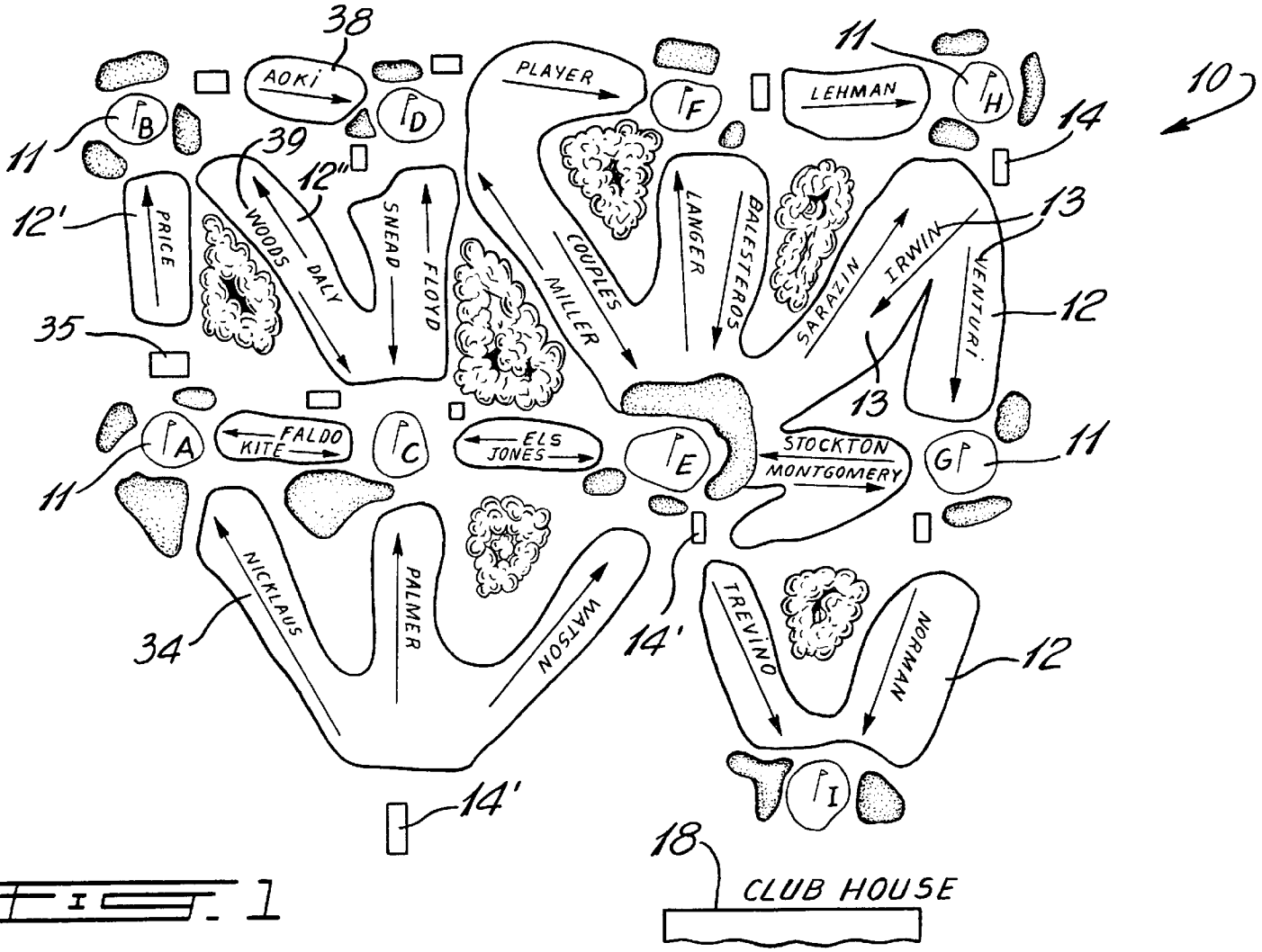
FIG. 1 is a plan view illustrating a golf course constructed in accordance with the web pattern of the present invention.

Referring now to the drawings and more particularly to FIG. 1, there is shown generally at 10 a golf course constructed in accordance with the present invention. As herein illustrated, the golf course comprises a plurality of putting green areas 11, herein nine of such putting green areas and these are disposed spaced-apart from one another. Each of the putting green areas are associated with one or more fairway areas 12. For example, the putting green area designated "B" is associated with a first fairway area 12' and a second fairway area 12" leading to it from different tee areas.

Figure 2:
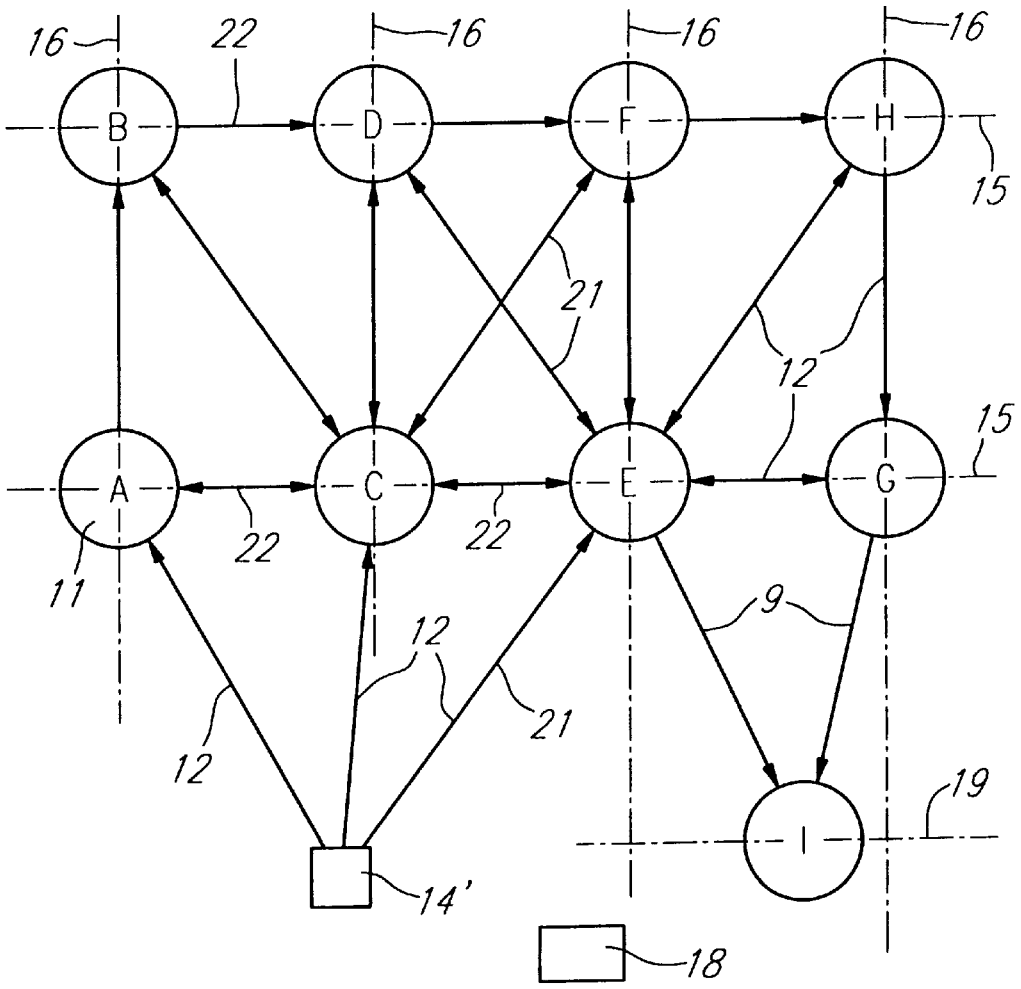
FIG. 2 is a diagrammatic view of the web pattern of the present invention and about which the golf course of FIG. 1 was developed.

Referring additionally to FIG. 2, it can be seen that each of the putting green areas A to I of FIG. 1 are associated with two or more fairway areas 12, that is to say, the straight lines interconnecting the putting green areas have at least two arrow heads pointing to each of the putting green areas. However, as will be described later, there are arrangements, and particularly with reference to FIG. 4, where a green area may be associated with a single fairway area. Each of the tee areas 14 and its associated fairway 12 are provided with a designation means and as shown in FIG. 1, this designation means 13 is the name of a golf person. Of course, it could be other types of designations but it is preferable that they not be numbered as it would make it more confusing on the golf course. The golf players would have more difficulty to follow tee areas if they were in numerical order. Each of the fairway areas 12 is also associated with one or two tee areas 14, herein designated by rectangular boxes. As also shown in FIG. 2, the green areas and fairway areas may be disposed in a predetermined web pattern to permit a plurality of sequential arrangements of the golf links, each link being constituted by a green area and an associated single one of the fairway areas and a tee area. FIG. 2 shows all possible fairway arrangements but in the construction of a golf course, some of these fairways may be omitted, such as shown in FIG. 1.

Figure 4:
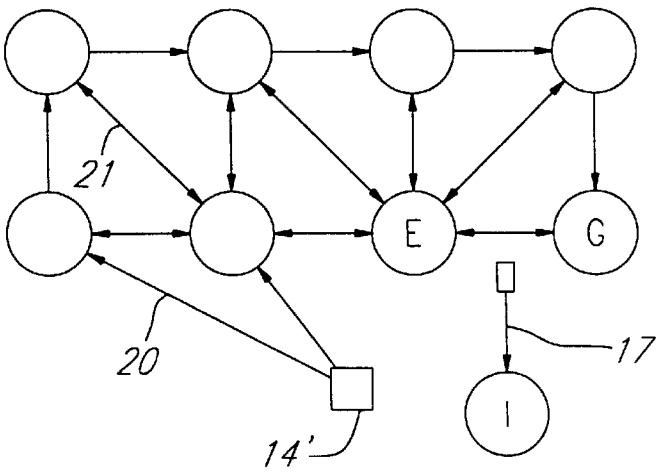
FIG. 4 is a diagrammatic view similar to FIG. 2 but illustrating a different arrangement of the first tee area and the ninth tee area.

FIG. 1 illustrates a golf course constructed in accordance with the web pattern of FIG. 2 of the present invention and as hereinshown there are nine putting green areas A to I. The web pattern is comprised of transverse axes, herein a first group 15 of axes consisting of two substantially parallel axes and a second group 16 of axes consisting of four substantially parallel transverse axes. As can be seen, the green areas 11 are oriented generally in a spaced-apart manner with relation to the first group of axes 15 and aligned transversely with one another in relation to the second group 16 of axes. A further one of the putting green areas, namely putting green area I, is spaced from the axes 15 and is associated with one or more of the fairway areas, herein two fairway areas identified by reference numeral 9, although, as shown in FIG. 4, it may be associated with a single fairway area 17 disposed substantially centrally and offset from the two green areas E and G. As shown in FIG. 2, the starting tee area 14' and the last one of the putting green area I, are located at predetermined positions with respect to one another when it is desirable that they be close to a golf club building, such as building 18 to provide services to the golf players. As hereinshown, the first tee 14' and the ninth golf putting green I, are located substantially on an axis 19 which is substantially parallel to the pair of axes of the first group 15. It is noted that although in FIG. 7 the putting green areas 11 are shown aligned on straight axes and at the intersection of axes, this is for purpose of illustrating the web pattern only, but FIG. 1 is more representative of a "real" layout where the orientations are more "with respect" to those axes.

Referring to FIG. 4, the starting tee area 14' may also be disposed in an offset fashion from the second group of axes 16 whereby to make some of the fairway areas, such as fairway area 20, much longer as is desirable with par 5 golf holes. It can also be seen that some of the fairway areas, such as fairway areas 21, are diagonal areas which extend diagonally between putting green areas. This is desirable also for par 5 holes where it is desirable that the fairway areas be longer. They are also utilized for longer par 4 holes. The closer spacing of the putting green areas, such as the spacings between putting areas A and C, C and E and E and G, for example, are shorter and are desirable for par 3 holes. These shorter fairway areas are designated by the lines 22 and when arrowheads are in opposed direction, it means that the fairway area can be played from either direction. Therefore, there are tee off areas at opposed ends of these fairway areas where arrowheads are pointing in opposed directions. As previously mentioned, there are more fairway areas than putting green areas to provide a web pattern having a plurality of different golf link sequential arrangements.

Referring to the Table illustrated in FIG. 3A, it can be seen that with a nine hole golf course laid out in accordance with the web pattern of the present invention, that eighteen different combinations of golf links are achievable with the layout of FIG. 2. The column "x" indicates nine consecutive golf links to be played and the eighteen columns "y" indicates the different sequential arrangements of the links associated with the links order column "x".

The Table of FIG. 3A is structured so that the golfers will start on the staring tee 14' and will play every green 11 only once in the first nine holes of play and in sequential order and further in a manner that groups of golfers do not play links that interfere with one another, that is to say will not cross one another. As also shown in FIG. 3A in different combinations some of the green areas are not in the same order and the fairways leading to these green areas are also different. In fact, some fairways can be played form opposite directions giving to the golfers a quite different physical appearance and level of difficulty.

FIG. 3B is a chart illustrating which sequential arrangements of golf links are available when it is desired to change the selected arrangement of the first nine links of play for the second nine links of play using the same nine links golf course. For example if the sequential arrangement of vertical column "12", $Y_1$ in FIG. 3A, is selected for the first nine holes of play, it is not possible to select the sequential arrangement of columns "1", "5", "6", "10", "14" and "18" of FIG. 3A. The available sequential arrangements to follow arrangement $Y_1$ is indicated by the vertical column "$Z_1$" in FIG. 3B. Only does links combinations of horizontal column $Z_1$ where there is a check mark (✓) are available for the second nine links playable. As previously described these selections can be effected by the use of a computer program and a score card associated therewith can also e printed by a printer associated with the computer. On the other hand, groups of score cards can be printed ahead of time for a variety of different links combinations.

FIG. 3C is a starting time schedule 41 illustrating how times can be scheduled for the nine links golf course of FIGS. 1 and 2. As shown herein, the links combinations are changed for three consecutive rounds of golf of the nine links course. A free time slot 40 is made available at the beginning of each different links combinations, herein combinations "12", "15" and "10", to provide for the first starting hole of each links combination to be liberated, at least on the starting times schedule 41. For purpose of illustration, a time slot 42 was left open in the schedule of the first nine links and later completed with a golfer(s) "L" in the second combination "15" of play. Players A to K have completed playing eighteen golf links at time 11:00 but not "L". He will continue to play through combination 10 starting at time 11:20 until time 13:20, where golfer(s) "L" complete their eighteen links of play.

Figure 5:
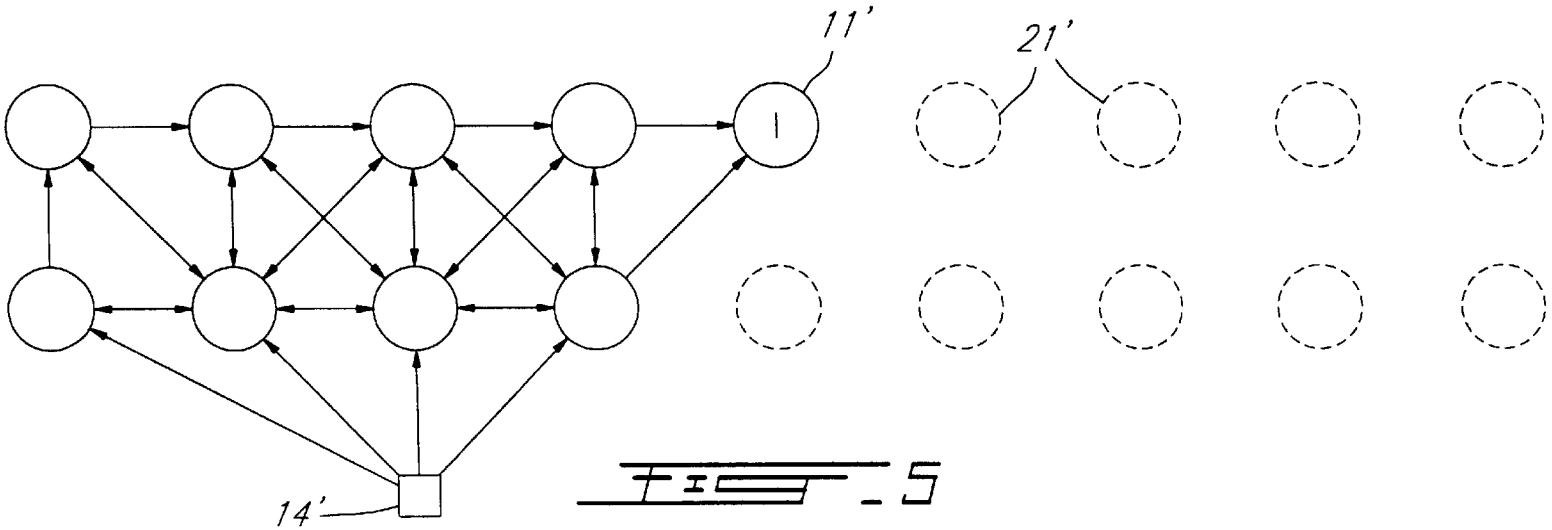
FIG. 5 is a diagrammatic illustration similar to FIG. 4 but showing a modification thereto and the manner in which an additional web pattern can be integrated with an existing web pattern.

With reference to FIG. 5, it can be seen that the web pattern as shown in FIG. 2 permits another arrangement of the first tee area 14' and the ninth putting green area I. As hereinshown, the ninth putting green area identified by reference numeral 11' is located on one of the axes of the first group 15 of parallel axes. This permits for another web pattern of 9 holes, herein identified by the golf links shown in phantom lines at 21' to be positioned in a side-by-side arrangement whereby to extend the 9-hole golf course to an 18-hole golf course. This again would increase the number of sequential arrangements of the golf links that can be achieved with an 18-hole golf course. The Table in FIG. 3A indicates the eighteen different sequential arrangements of the 9 putting green course and associated fairway areas illustrated in FIG. 2.

Figure 6:
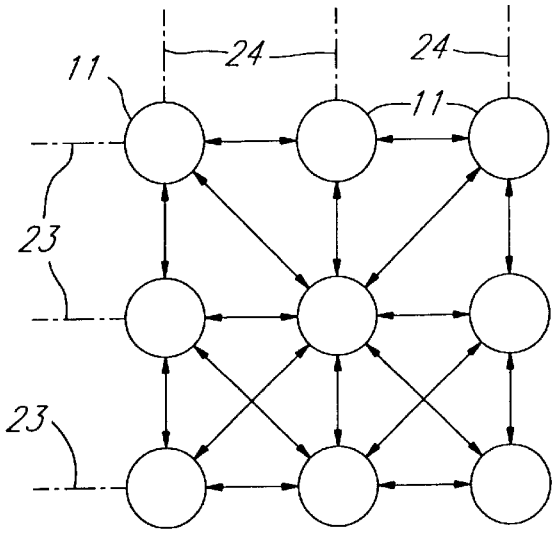
FIG. 6 is a still further diagrammatic illustration showing a web pattern but with the putting green areas oriented in a different web pattern than that illustrated in FIGS. 3 to 5.

FIG. 6 illustrates a further web pattern which consists of a first group of three spaced-apart substantially parallel axes 23 and a second group of three spaced-apart substantially parallel transverse axes 24. Three of the putting green areas 11 are oriented in relation to the crossings of each of said group of axes. With this arrangement, it is possible to achieve 36 golf links with eighteen fairway areas. The sequential arrangements Table would provide up to 44 different arrangements of golf links using nine green putting areas. If this web pattern of 9 holes is doubled, it can produce a sequential arrangement of 1,936 arrangements with eighteen putting green areas.

Figure 7:
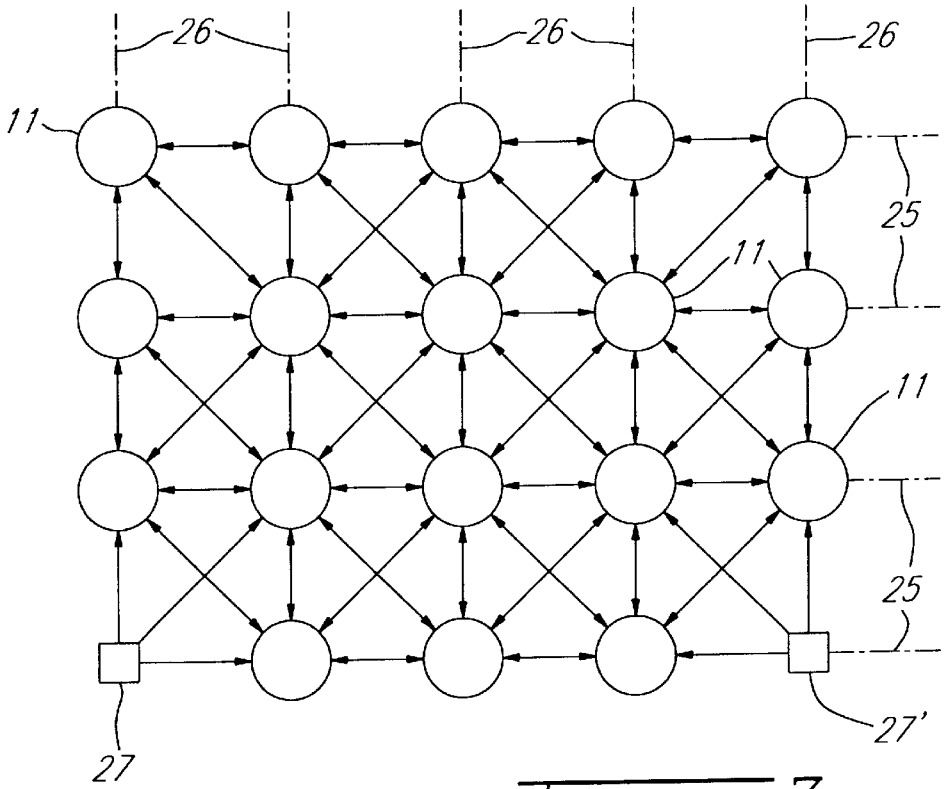
FIG. 7 is a still further diagrammatic illustration indicating a further web pattern.

FIG. 7 illustrates a still further web pattern constructed in accordance with the present invention and wherein the web pattern is comprised of a first group of four spaced-apart substantially parallel axes 25 and a second group of five spaced-apart substantially parallel transverse axes 26. The putting green areas are again oriented in relation to the crossings of each of the groups of axes. As hereinshown the starting tee area 27 is disposed in alignment with an outside one of the first and second group of axes 25 and 26. A starting tee area can also be provided in the opposed corner of the groups of axes, as indicated by reference numeral 27'This 18 putting green area arrangement can produce 100 golf links with 52 fairways. It generates in excess of 8,000 different sequential arrangements of golf links.

Figure 8:
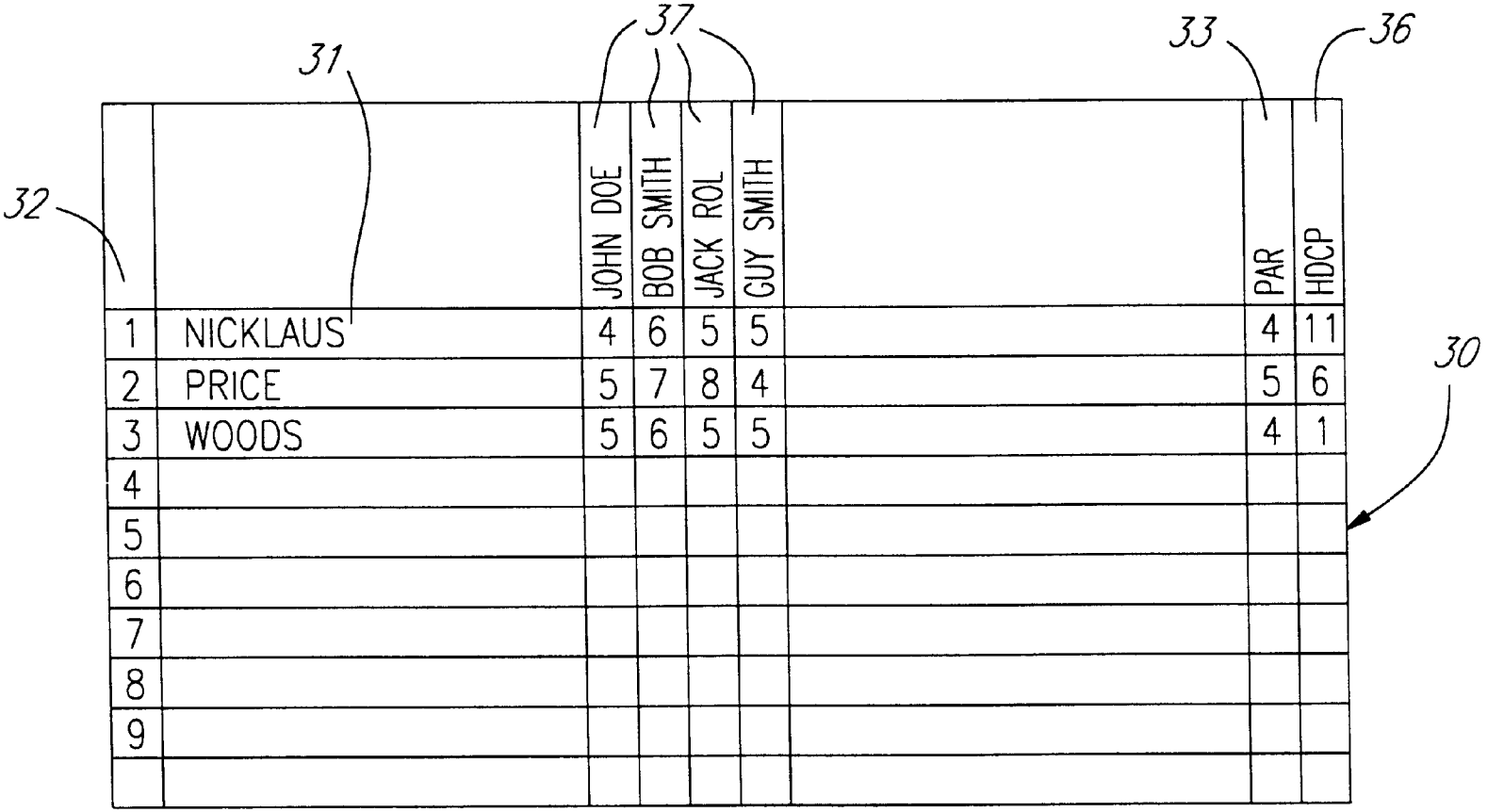
FIG. 8 is a plan view of a score-keeping card associated with the present invention.
Figure 9A:
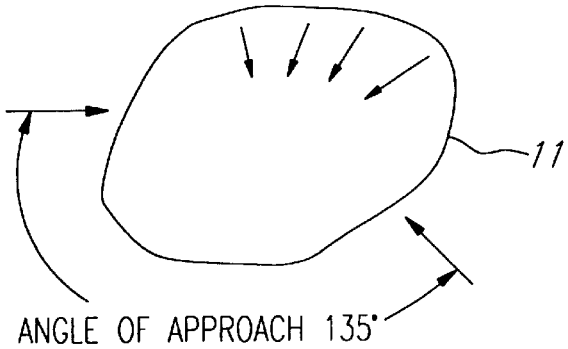
FIGS. 9A to 9D are schematic diagrams of different putting green shapes depending on the position of the different fairways associated therewith, as shown in FIG. 4.
Figure 9B:
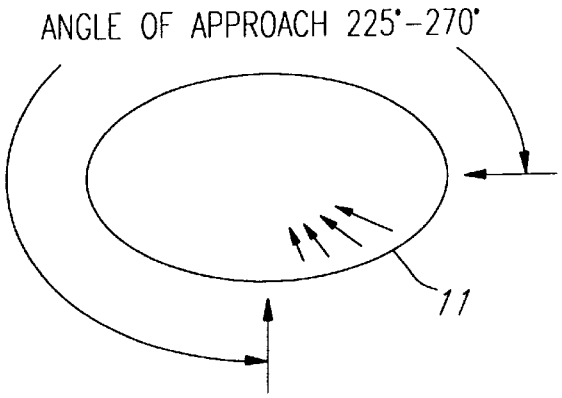
Figure 9C:
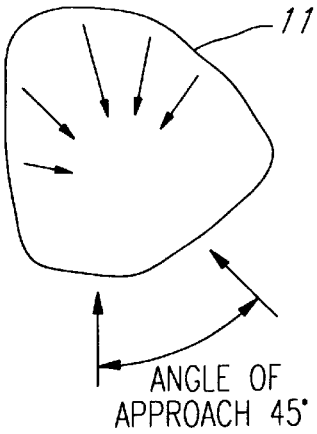
Figure 9D:
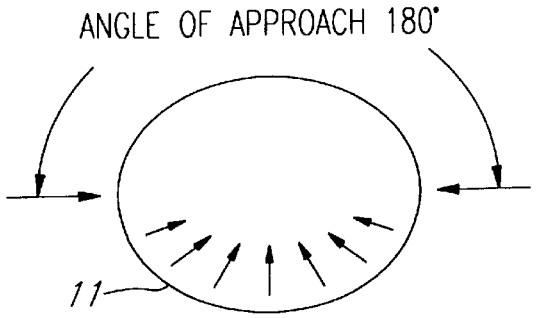

FIG. 8 illustrates an example of a score card constructed in association with the web pattern golf course as illustrated in FIG. 1. As hereinshown, the score-keeping golf card 30 is different than conventional score-keeping golf cards. Depending on a selected one of the plurality of sequential arrangements of the links, the order of the links is printed in the column 31 to indicate the order of play of the golf links numerically indicated in column 32. Accordingly, with reference to FIG. 1, a player starts on the starting tee 14' and if from there plays the Nicklaus fairway 34, he will arrive at the putting green 11 designated by the letter A. From there his score card directs him to the tee box 35 where he will play the fairway indicated by the designation name Price (see column 31 on the score card 30), namely fairway 12' to arrive at putting green designated B. The score of the player on each link is inscribed in column 37 while the links handicap rating is indicated in column 33. Each of the golf links is given a handicap rating which is inscribed in column 36. The golf player simply follows the order of the golf links designation in column 31 on the card. For example, after the second hole, herein the putting green B, the player may be directed to either the fairway area 38 having the designated name "Aoki" or the fairway area 39 having the designation "Woods". And the game continues throughout the 9- or 18-holes of play. It is also to be understood that these score keeping cards 30 can be computer-generated by selecting a particular sequential arrangement of the golf links from the numerous arrangements which are possible with the web pattern layout of the links as described herein. The backside of the score-keeping card 30 preferably will contain a printing of the golf course layout on which the selected course combination shown in column 31 will be indicated by arrows or only the printed link name utilized.

FIGS. 9A to 9D illustrate typical putting green shapes and undulations to suit the multiple angles of approach to the green when associated with more than one fairway. These putting greens are those shown in the links arrangement of FIG. 4. The arrows on each of the putting greens indicate slope direction.

The method of constructing a golf course using the web pattern of the present invention makes it possible to obtain to plurality of sequential arrangements of golf links within a single golf course with nine or more links. The method consists of disposing a plurality of putting green areas, in a spaced-apart manner, and oriented with respect to a web pattern having at least two substantially parallel, spaced-apart axes and at least three substantially parallel transverse axes. These axes are identified on a land surface by land surveyors, in a manner well known in the art. The fairway areas are delineated between the putting green areas along these axes. Diagonal fairway areas are also formed along diagonal axes between some of the putting green areas but not all of them in order to maintain a golf course which is of the traditional type. Tee areas are associated with the fairway areas and in some fairways may be disposed in association with opposed ends of the fairway areas. Designation means, herein names of famous golf players, are associated with each of the golf links and these would be made visible at the tee box areas and next to green areas to direct traffic. As previously described there are more fairway areas than putting green areas to obtain the large number of sequential arrangements of the golf links.

With the golf links arrangements of the present invention it can be seen that certain fairway areas are liberated in each of the available combinations. This makes it possible for maintenance personnel to effectuate work on these liberated fairways during golf play. Also, if one or two additional putting green areas and associated fairway areas and tee areas are added to the 9 hole course, then entire links could be scheduled for maintenance purposes each time the nine links combination is changed. It is also possible with the web pattern design of the present invention to reduce the total surface area of land normally required to layout 18 links of golf.

It is also pointed out that the present invention can also be applied for the construction of a miniature putting golf course or a par 3 golf course or a chip-and-putt-golf course or any other type where there is a teeing area and a fairway-like area leading to a green area in which a golf cup is disposed.

It is within the ambit of the present invention to cover any obvious modifications of the examples of the preferred embodiment described herein, provided such modifications fall within the scope of the appended claims.

I claim:

1. A golf course comprising a plurality of putting green areas, said putting green areas being spaced apart from one another and some of said putting green areas being associated with one or more fairway areas to constitute a plurality of golf links, all of said green areas being separated from one another by one of said fairway areas, a tee area associated with one or more of said fairway areas of each said golf links, designation means to identify individual ones of said golf links, said green areas and fairway areas being disposed in a predetermined web pattern to permit a plurality of sequential arrangements of said links with said putting green areas having a single associated one of said fairway areas in each said sequential arrangement without any fairway areas crossing one another, at least one of said putting green areas being displaced to a different position in each said plurality of sequential arrangements, said web pattern having at least a plurality of said putting green areas oriented and aligned with respect to one another at intersections of grid lines formed by spaced parallel axes disposed at right angles to one another, there being a starting tee area spaced from one or more designated green areas, said fairway areas being disposed between said green areas on said parallel axes and diagonally between some of said putting green areas on diagonal axes and also between said starting tee area and said one or more designated green areas.

2. A golf course as claimed in claim 1 wherein there are nine of said putting green areas which together with said fairway areas associated with each said putting green areas form said web pattern.

3. A golf course as claimed in claim 2 wherein there are at least two of said web patterns in said golf course and oriented in association with one another to constitute a golf course having eighteen of said golf links.

4. A golf course as claimed in claim 1 wherein said web pattern is comprised of a pair of spaced-apart substantially parallel axes and four spaced-apart transverse axes, there being four of said putting green areas oriented and aligned with each axis of said pair of substantially parallel axes, a further one of said putting green areas being oriented spaced from said substantially parallel axes and associated with one or more of said fairway areas.

5. A golf course as claimed in claim 4 wherein said starting tee area and said further one of said putting green areas are located at predetermined positions with respect to one another and to some of said plurality of putting green areas.

6. A golf course as claimed in claim 4 wherein said further one of said putting green areas and said starting tee area are oriented spaced to one side of one of said substantially parallel axes.

7. A golf course as claimed in claim 4 wherein said further one of said putting green areas is oriented and aligned with one of said substantially parallel axes.

8. A golf course as claimed in claim 7 wherein there are two of said web patterns in said golf course, and oriented in association with one another, with said putting green areas oriented and aligned with each axis of said pair of substantially parallel axes.

9. A golf course as claimed in claim 1 wherein said designation means is a name associated with each said golf link, said names of said golf links in each said sequential arrangements being arranged different from one another to form different combinations.

10. A golf course as claimed in claim 1 wherein there is further provided a score-keeping golf card associated with each sequential arrangement of said links, said card having a plurality of said designation means printed thereon to indicate to a golf playing person a sequential arrangement of said golf links to direct the player person through said golf course.

11. A golf course as claimed in claim 1 wherein there is further provided a sequential arrangement Table indicating a listing of the order of said golf links in each said sequential arrangement of said links.

12. A golf course as claimed in claim 3 wherein there is further provided a chart designating particular sequential arrangements of said web patterns which can be associated together to constitute a golf course with two different sequential arrangements.

13. A golf course as claimed in claim 1 wherein said golf course is a miniature putting golf course.

* * * * *